US010950979B2

(12) United States Patent
Lödding et al.

(10) Patent No.: US 10,950,979 B2
(45) Date of Patent: Mar. 16, 2021

(54) ELECTRICAL CONNECTOR ASSEMBLY

(71) Applicant: Rosenberger Hochfrequenztechnik GmbH & Co. KG, Fridolfing (DE)

(72) Inventors: Thomas Lödding, Traunstein (DE); Gunnar Armbrecht, Tittmoning (DE); Thomas Müller, Berchtesgaden (DE); Rainer Bippus, Teisendorf (DE); Richard Pichlmaier, Fridolfing (DE)

(73) Assignee: ROSENBERGER HOCHFREQUENZTECHNIK GMBH & Co. KG, Fridolfing (DE)

( * ) Notice: Subject to any disclaimer, the term of this patent is extended or adjusted under 35 U.S.C. 154(b) by 0 days.

(21) Appl. No.: 16/347,201

(22) PCT Filed: Aug. 31, 2017

(86) PCT No.: PCT/EP2017/071872
§ 371 (c)(1),
(2) Date: May 3, 2019

(87) PCT Pub. No.: WO2018/082827
PCT Pub. Date: May 11, 2018

(65) Prior Publication Data

US 2019/0393651 A1 Dec. 26, 2019

(30) Foreign Application Priority Data

Nov. 4, 2016 (EP) ..... 16197325

(51) Int. Cl.
*H01R 13/64* (2006.01)
*H01R 13/6463* (2011.01)
(Continued)

(52) U.S. Cl.
CPC ..... *H01R 13/6463* (2013.01); *H01R 13/518* (2013.01); *H01R 13/6471* (2013.01); *H01R 13/6477* (2013.01)

(58) Field of Classification Search
CPC ..... H01R 13/6463; H01R 13/518; H01R 13/6471; H01R 13/6477
(Continued)

(56) References Cited

U.S. PATENT DOCUMENTS 7,431,619 B2 * 10/2008 Boehnlein ..... G02B 23/2476 439/882
9,666,985 B2 * 5/2017 Bernardi ..... H01R 13/631
(Continued)

FOREIGN PATENT DOCUMENTS

DE 202015000753 U1 3/2015
WO 2012078824 A2 6/2012
WO 2016120006 A1 8/2016

*Primary Examiner* — Alexander Gilman
(74) *Attorney, Agent, or Firm* — David P. Dickerson

(57) ABSTRACT

The invention relates to an electrical connector assembly, comprising an electrical connector and a cable connected to the electrical connector, which each have at least one conductor pair for transferring a differential signal, wherein the cable has a first section and the electrical connector has a second section, in which second section the conductor pair has plug contacts, and wherein the conductors have a first mutual distance (X) in the first section and a second mutual distance (Y) in the second section, which second mutual distance is greater than the first distance, wherein an intermediate section, in which the distance of the conductors of a conductor pair increases toward a plugging end of the electrical connector, is formed between the first section and the second section, wherein the conductor pair is surrounded by a conductor pair shield in the first section and/or in the second section, which conductor pair shield shields the conductor pair from external electromagnetic influences,
(Continued)

and wherein the conductors are surrounded by a conductor shield in at least part of the intermediate section, which conductor shield shields the conductors from external electromagnetic influences and from electromagnetic influences of the other conductor. The invention further relates to a method for signal transfer.

19 Claims, 11 Drawing Sheets

(51) Int. Cl.
*H01R 13/518* (2006.01)
*H01R 13/6471* (2011.01)
*H01R 13/6477* (2011.01)

(58) Field of Classification Search
USPC ..... 439/638
See application file for complete search history.

(56) References Cited

U.S. PATENT DOCUMENTS

| | | | | |
|---|---|---|---|---|
| 10,103,500 | B2 * | 10/2018 | Zebhauser | H01R 4/20 |
| 2006/0035514 | A1 * | 2/2006 | Yohn | H01R 9/03 439/460 |
| 2007/0259568 | A1 * | 11/2007 | Mackillop | H01R 13/6463 439/638 |
| 2014/0273619 | A1 * | 9/2014 | Showcatally | H01R 13/60 439/550 |

* cited by examiner

ELECTRICAL CONNECTOR ASSEMBLY

FIELD OF THE INVENTION

The invention relates to a connector arrangement comprising a connector and a cable which is connected to the connector. The cable guides at least one pair of conductors for transmitting a differential signal in each case.

TECHNICAL BACKGROUND

DE 202015000753 U1 describes a connector arrangement comprising a sleeve part. In this case, a pair of cores for transmitting a differential signal runs in a cable, wherein the cores of the pair of cores are at a first mutual distance in the interior of the cable. Starting from the sheathed cable section, the two cores of the pair of cores run away from one another in the direction of the connector in an intermediate section until they enter a guide section of the connector in which they are at a second mutual distance which is greater than the first mutual distance.

US 2007/259568 A1 describes a connector arrangement comprising a connector and a cable which is connected to the connector, which connector and cable each have at least one pair of conductors for transmitting a differential signal, wherein the cable has a first section and the connector has a second section in which the pair of conductors has electric contacts, and wherein the conductors are at a first mutual distance (X) in the first section and are at a second mutual distance (Y), which is greater than the first distance, in the second section, wherein an intermediate section, in which the distance between the conductors of a pair of conductors is increased in the direction of a interface-side end of the connector, is formed between the first section and the second section.

WO 2012/078824 describes a connector arrangement comprising a connector and a cable which is connected to the connector, which connector and cable each have at least one pair of conductors for transmitting a differential signal, wherein the cable has a first section and the connector has a second section in which the pair of conductors has electric contacts.

Owing to the change in distance between the cores or conductors, the differential impedance of said cores or conductors changes, as a result of which an interference point can occur.

This is a state for which improvement is sought.

SUMMARY OF THE INVENTION

Against this background, the object of the present invention is to specify a connector arrangement for transmitting differential signals, which connector arrangement has improved transmission characteristics.

The present disclosure teaches a connector arrangement comprising a connector and a cable which is connected to the connector, which connector and cable each have at least one pair of conductors for transmitting a differential signal, wherein the cable has a first section and the connector has a second section in which the pair of conductors has electric contacts, and wherein the conductors are at a first mutual distance (X) in the first section and are at a second mutual distance (Y), which is greater than the first distance, in the second section, wherein an intermediate section, in which the distance between the conductors of a pair of conductors is increased in the direction of a interface-side end of the connector, is formed between the first section and the second section, wherein the pair of conductors is surrounded by a shield for a pair of conductors in the first section and, in particular, in the second section, which shield for a pair of conductors shields the pair of conductors against external electromagnetic influences, and wherein the conductors are each surrounded by a conductor shield in at least one part of the intermediate section, which conductor shield shields each of the conductors against external electromagnetic influences and against electromagnetic influences of the respectively other conductor.

The present disclosure moreover teaches a method for transmitting a signal between a connector and a cable which is connected to the connector, which connector and cable each have at least one pair of conductors, comprising the following steps: transmitting a differential signal in a first section in the cable, in which first section the conductors are at a first mutual distance (X); transmitting a single-ended signal in an intermediate section in which the distance between the conductors is increased in the direction of a interface-side end of the connector; transmitting a differential signal in a second section in the connector, in which second section the conductors are at a second mutual distance (Y) which is greater than the first distance.

In the text which follows, the first section is understood to be a section in the cable in which the conductors are guided in a differential manner and are at a first mutual distance. Differential guiding means that a plurality of conductors are jointly shielded by one shield for a pair of conductors.

The distance between the conductors is increased in the direction of the connector in at least one part of the intermediate section. In the text which follows, this region is called the intermediate section. The conductors are separately shielded by a conductor shield in at least one part of the intermediate section. In the text which follows, this region is called the shield section. The conductor shield at least partially shields the conductors from one another. It is self-evident that the intermediate section and the shield section both can coincide and also can be formed immediately adjacent to one another.

In the second section, the conductors are preferably guided in a differential manner and are at a second mutual distance.

The idea on which the present invention is based is that of routing a signal in a differential manner in the first section in the cable and in the second section in the connector, whereas the signal is routed in a single-ended manner in the shield section.

This means that the two conductors of the pair of conductors are shielded against external electromagnetic influences in the first section and the second section by a common shield for a pair of conductors in each case. The conductors of the pair of conductors are therefore coupled to one another and electrically influence one another.

In the shield section, the conductors are each shielded by an isolated conductor shield against external electromagnetic influences and also against influences of the respectively other conductor. As a result, the coupling between the conductors is reduced. As a result, an interference point in the differential mode can be considerably reduced. In particular, it can be advantageous to accept an interference point in the common mode when a useful signal is transmitted in the differential mode and therefore an interference point in the differential mode can be reduced.

Advantageous refinements and developments can be gathered from the further dependent claims and also from the description with reference to the figures of the drawing.

According to one preferred development, the conductor shield is designed to surround the conductors over the entire circumference. Therefore, the undesired coupling between the conductors in the intermediate section can be minimized. Therefore, an interference point can be further reduced.

According to one preferred development, the conductor shield has a conductive spacer between the conductors, the said conductive spacer being designed to determine the profile of the conductors. Therefore, the impedance in this region can be adjusted particularly accurately.

According to one preferred development, an impedance in the first and second section and also in the intermediate section is in each case tuned with respect to the impedance in the other sections. Therefore, it is possible to reduce interference points in the common mode or differential mode.

In particular, it is expedient to tune the impedance by changing a diameter of the conductors, owing to a distance of the conductors from the conductor shield or shield for a pair of conductors.

According to one preferred development, the first section has a first insulating part between the pair of conductors and the shield for a pair of conductors, and the intermediate section has a second insulating part between the conductors and the conductor shield, wherein a thickness of the first insulating part is greater than a thickness of the second insulating part.

Therefore, the capacitance between the conductors and the shield of the said conductors is increased in the intermediate section in comparison to the first section. Since the capacitance between the two conductors reduces within the widening section on account of the increasing distance between the two conductors, the increase in capacitance between the conductors and the conductor shield can balance the total capacitance of a pair of conductors within the intermediate section and match it to the total capacitance of the pair of conductors in the first section. Matching of the differential impedance of the conductors in the intermediate section to the differential impedance of the respective pair of conductors in the first section can be achieved in this way.

According to one preferred development, the conductor shield is composed of a plurality of parts, in particular of half-shells. A multipartite conductor shield can be fitted in a particularly simple manner. In addition, a conductor shield with two half-shells has particularly expedient electrical properties in which a production-related air gap between the plurality of parts can be kept small, and therefore the mutual coupling between the conductors can be further reduced.

In order to further reduce the mutual coupling between the conductors, the plurality of parts can have a mutually corresponding, uneven surface profile. By way of example, the surface profiles can have a serrated profile, in particular in a W or V shape, which serrated profiles respectively form a negative relative to one another.

As an alternative, the conductor shield can be of unipartite design and have bushings in which a conductor is received in each case. This embodiment is particularly robust and can ensure the mutual coupling between the conductors even under vibration influences or other mechanical loads.

According to one preferred development, the conductor shield has a plurality of separate conductor shields for the conductors. It is self-evident that the conductor shield does not have to be of coherent design in any way. Rather, it may also be expedient to shield the conductors by separate individual shields in the shield section. The separate conductor shields can be electrically contact-connected to one another.

According to one preferred development, the conductor shield follows a contour of the conductors throughout the shield section. In this way, the distance between the conductors and the conductor shield can be kept constant. This is advantageous in respect of adjusting the impedance.

According to one preferred development, the conductor shield is electrically conductively connected to the shield for a pair of conductors in the first and/or in the second section. The shields are DC-coupled in this way.

It is self-evident that the features cited above and those still to be explained below can be used not only in the respectively specified combination but also in other combinations or on their own, without departing from the scope of the present invention.

The above refinements and developments can, where appropriate, be combined with one another in any desired manner. Further possible refinements, developments and implementations of the invention also comprise not explicitly cited combinations of features of the invention that are described above or below in respect of the exemplary embodiments. In particular, a person skilled in the art will also add individual aspects in this case as improvements or additions to the respective basic form of the present invention.

CONTENTS OF THE DRAWING

The present invention will be explained in greater detail below using the exemplary embodiments which are shown in the diagrammatic figures of the drawing, in which.

Figure 12A:
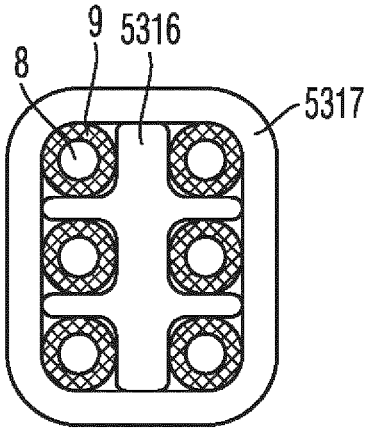
Figure 13A:
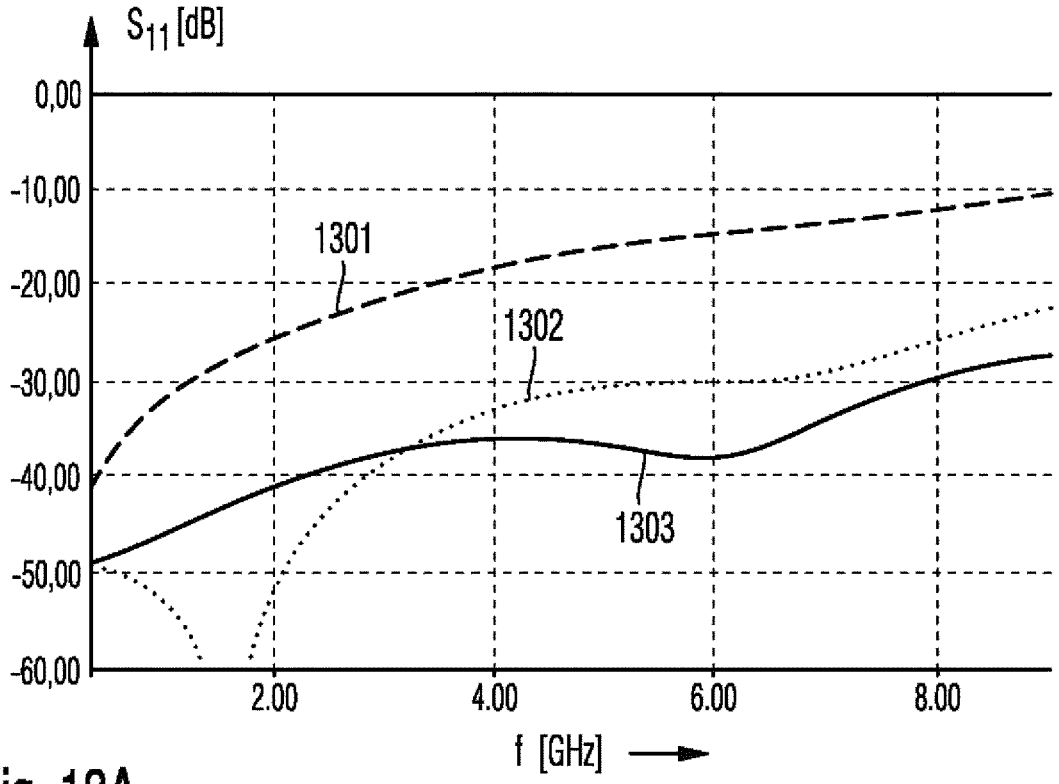
Figure 13B:
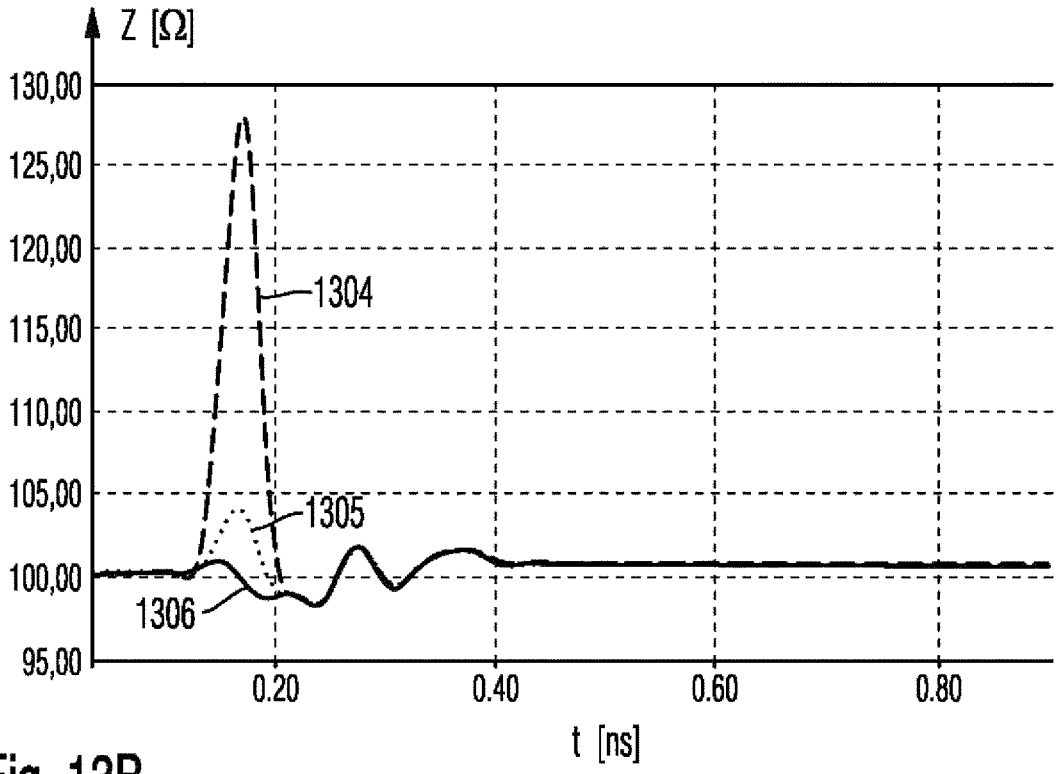

FIGS. 12A, B show illustrations of a cross section through a further embodiment of the invention;

FIG. 13A shows a spectral representation of the reflection behavior of the connector arrangement according to the invention and connector arrangements according to the prior art; and FIG. 13B shows a representation of the time response of the connector arrangement according to the invention and connector arrangements according to the prior art.

The accompanying figures of the drawing are intended to provide a further understanding of the embodiments of the invention. They illustrate embodiments and, in conjunction with the description, serve to explain principles and concepts of the invention. Other embodiments and many of the advantages mentioned become apparent in view of the drawings. The elements shown in the drawings are not necessarily shown true to scale in relation to one another.

In the figures of the drawing, identical, functionally identical and identically acting elements, features and components are respectively provided with the same reference symbols—unless stated otherwise.

The figures are described below in a coherent and comprehensive manner.

DESCRIPTION OF EXEMPLARY EMBODIMENTS

Figure 1:
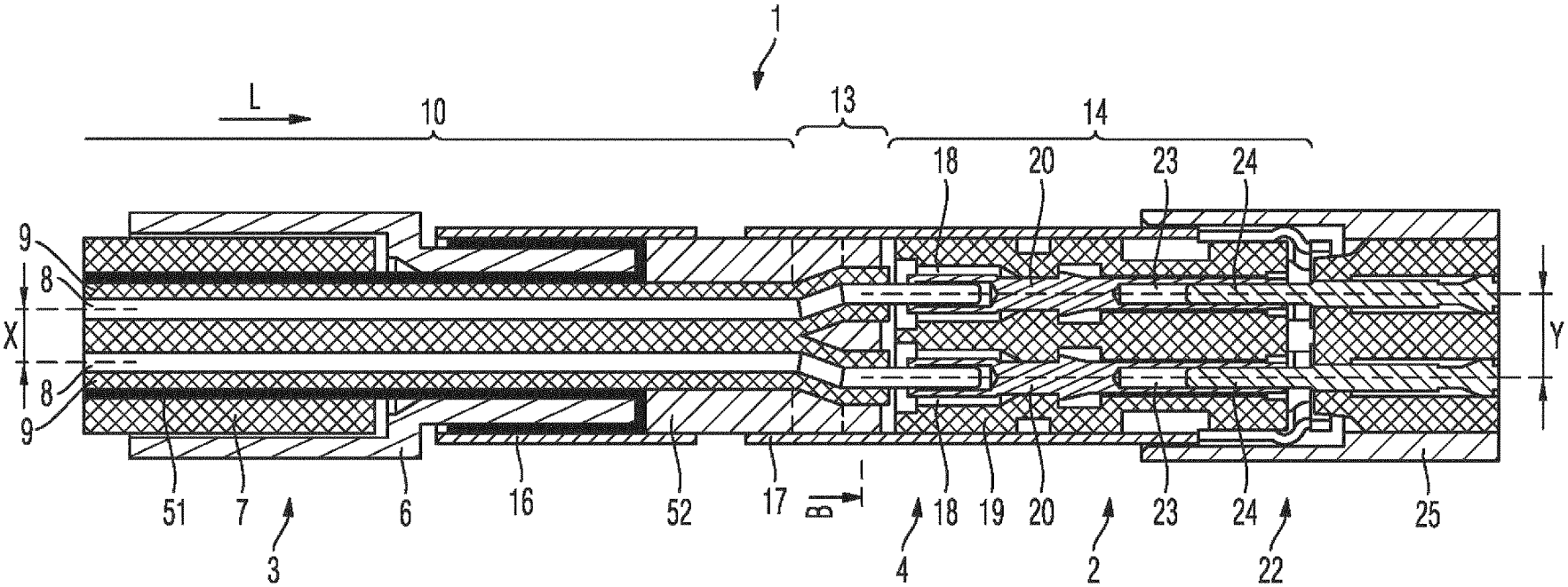
FIG. 1 shows an illustration of a longitudinal section through one embodiment of the invention with a mating connector inserted.

FIG. 1 shows an illustration of a longitudinal section through one embodiment 1 of a connector arrangement according to the invention with a mating connector inserted.

The connector arrangement 1 according to the invention has a connector 2 and a cable 3 which, at the cable-side end 4 of the connector 2, is mechanically and electrically connected to the connector 2.

The cable 3 is shielded by a shield 51, 52 for a pair of conductors. At the same time, the shield 51 for a pair of conductors forms an external conductor of the cable. This shield 51 for a pair of conductors can be in the form of a wire mesh or in the form of an electrically conductive film-type shield. The end of the shield 51 for a pair of conductors is placed around a supporting sleeve 6 which is fitted onto the shield 51 for a pair of conductors, and the shield 51 for a pair of conductors is axially fixed in relation to the conductors 8 of the cable 3. A cable sheath 7 which is composed of a plastic material and is placed around the shield 51 for a pair of conductors of the cable 3 is arranged in front of the supporting sleeve 6.

A plurality of conductors 8, here a pair of conductors, are guided within the shield 51 for a pair of conductors. The conductors 8 are each encased by a first insulating part 9. The conductors 8 respectively form a core with the respective insulating part 9. The conductors 8 are twisted with one another (twisted pair cable). As an alternative, the conductors 8 can also run in parallel (twin ax(ial) cable). The pair of conductors transmits a differential signal, for example a high-frequency differential signal.

The conductors 8 run in the longitudinal direction L of the cable 3 and are at a first mutual distance X within the cable 3 in the first section 10.

A further shield 52 for a pair of conductors, which initially jointly shields the pair of conductors in the further profile of said pair of conductors, is formed following the shield 51 for a pair of conductors.

The region of the cable 3 as far as the conductor shield 53 therefore forms the first section 10.

In FIG. 1, the intermediate section 13 is subdivided into a widening section, in which the distance between the conductors is increased, and into a shield section, in which the conductors are shielded from one another by the conductor shield 53. The shield section is identical to the intermediate section 13. The widening section is limited to a front part of the intermediate section 13.

The shield 52 for a pair of conductors has a conductor shield 53, which splits the pair of conductors to form individual conductors, between the conductors 8 in a interface-side end region. Therefore, the shield 52 for a pair of conductors is both a shield for a pair of conductors and also a conductor shield in the end region. The conductor shield 53 can be of unipartite design or multipartite design with the shield 52 for a pair of conductors.

Unipartite shields 52, 53 can be cast or inserted and fixed during assembly. Reference is made to FIGS. 8A-8F in respect of exemplary configurations between a conductor shield 53 and a shield 52 for a pair of conductors.

The distance between the individual conductors 8 increases from the first mutual distance X to the greater second mutual distance Y within the shield 52 for a pair of conductors in the intermediate section 13. After this point, the distance between the conductors 8 in the intermediate section 13 remains constant and the conductors 8 run parallel to one another.

In order to avoid or to reduce a possible air gap between the shield 52 for a pair of conductors or the conductor shield 53 and the insulating part 9, the shield 52 for a pair of conductors or conductor shield 53 can be in the form of a unipartite potting compound which surrounds the conductors 8, as far as possible without intermediate spaces. As an alternative, the shield 52 for a pair of conductors or conductor shield 53 can also be produced as a turned, milled or cast part.

The shield 52 for a pair of conductors is electrically connected to the shield 51 for a pair of conductors by means of a conductive crimp sleeve 16. The crimp sleeve 16 is guided coaxially over the supporting sleeve 6 to this end. For the purpose of DC-coupling or electrically connecting the shield 51 for a pair of conductors of the cable 3 to the shield 17 for a pair of conductors of the connector 2, the shield 17 for a pair of conductors is placed over the shield 52 for a pair of conductors which is in turn connected to the shield 51 for a pair of conductors.

The conductors 8 are guided in associated guide channels 18 in the second section 14. The conductors 8 are at the distance Y from one another and are surrounded by an insulating part 19. The conductors 8 are electrically connected to associated internal conductor contact elements 20 within the guide channels 18. The electrical connection can be made, for example, by means of soldering or crimping.

The internal conductor contact elements 20 each have a socket-like recess 23 for receiving an associated contact pin 24 of a mating connector 25 at the connector-side end 22 of the connector 2.

As an alternative, the internal conductor contact elements 20 can also be realized as contact pins and can be inserted into associated socket-like contact elements of the mating connector 25 so as to protrude beyond the interface-side end 22 of the connector 2. The connector 2 can also be realized as a coupler which connects the cable 3 to a further cable.

Figure 2:
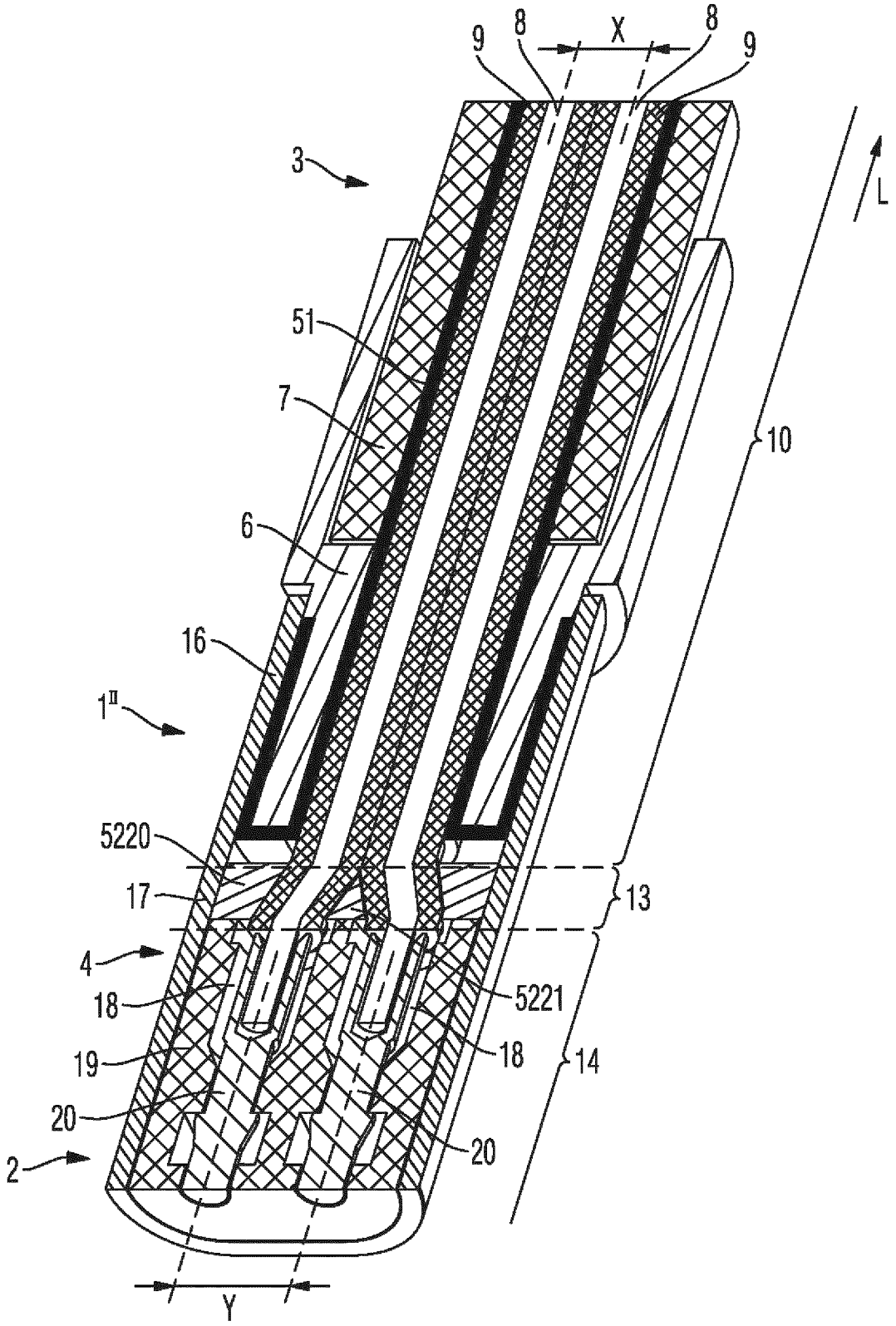
FIG. 2 shows an illustration of a longitudinal section through a further embodiment of the invention.

FIG. 2 shows a further embodiment 1" of a connector arrangement according to the invention in which the shield 5220 for a pair of conductors with the conductor shield 5221 is shorter than in the case of the embodiment above. Accordingly, the shield section and the widening section coincide in the intermediate section. Consequently, the intermediate section is also shorter than in the above embodiments.

Figure 3:
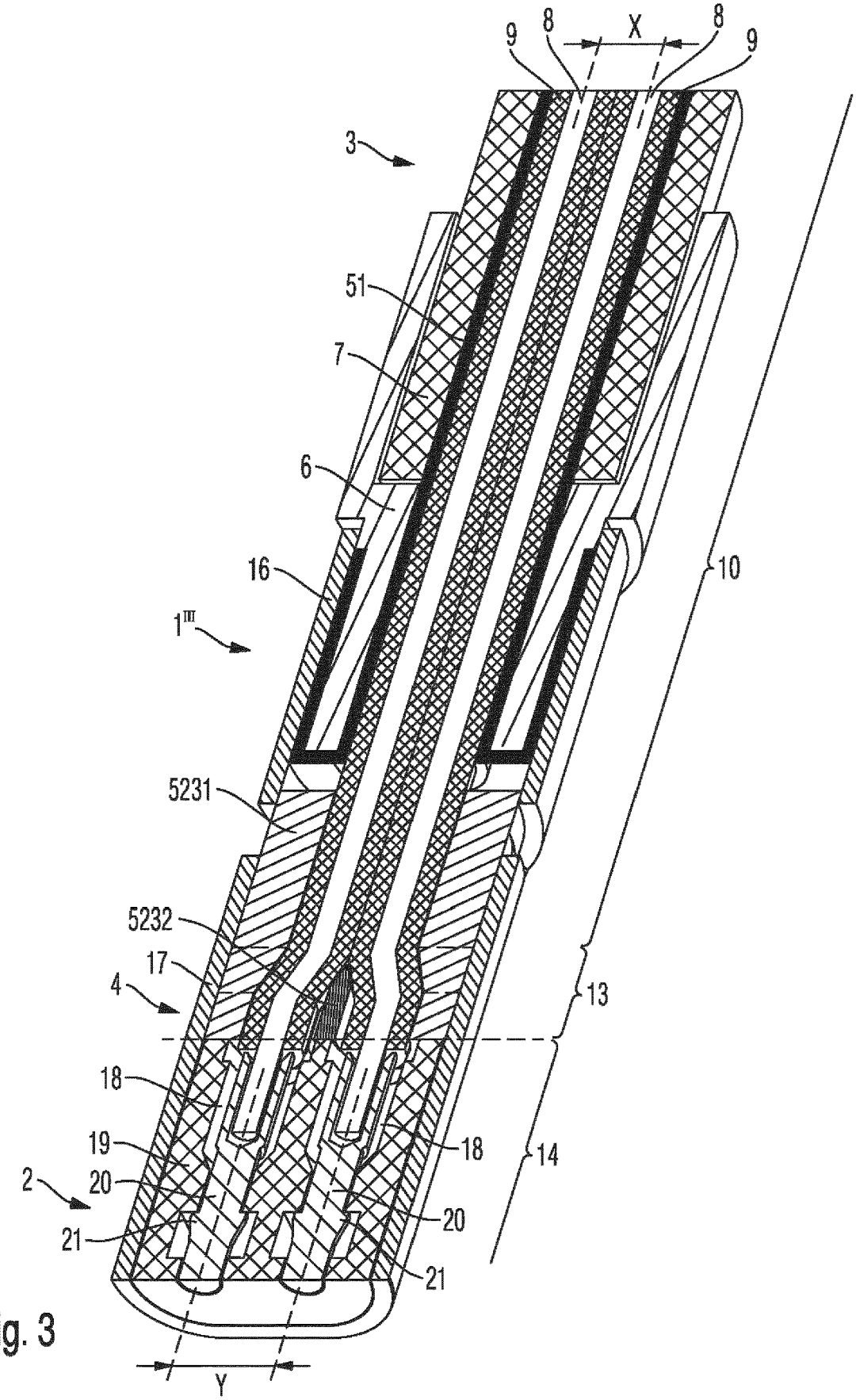
FIG. 3 shows an illustration of a longitudinal section through a further embodiment of the invention.

FIG. 3 shows a further embodiment 1'" of the invention, in which the widening section extends over a part of the shield section similarly to FIG. 1. The shield element 5230 with the conductor shield 5232 and the shield 5231 for a pair of conductors extends over the intermediate section 13 and also over a part of the first section 10. The shield 5231 for a pair of conductors forms a shield case. The conductor shield is in the form of an isolating element which isolates the conductors 8.

For the purpose of axially fixing the internal conductor contact element 20 in the insulating part 19 of the connector 2, the said insulating part has a radially outwardly directed spring element 21 which is respectively supported on an end face of an annular slot in the guide channel 18 within the insulating part 19.

In FIG. 3, there is an intermediate space containing air between the conductors 8 and the conductor shield 5232. It is self-evident that the intermediate space can be adapted in an application-specific manner in accordance with electrical requirements and manufacturing conditions.

Figure 4:
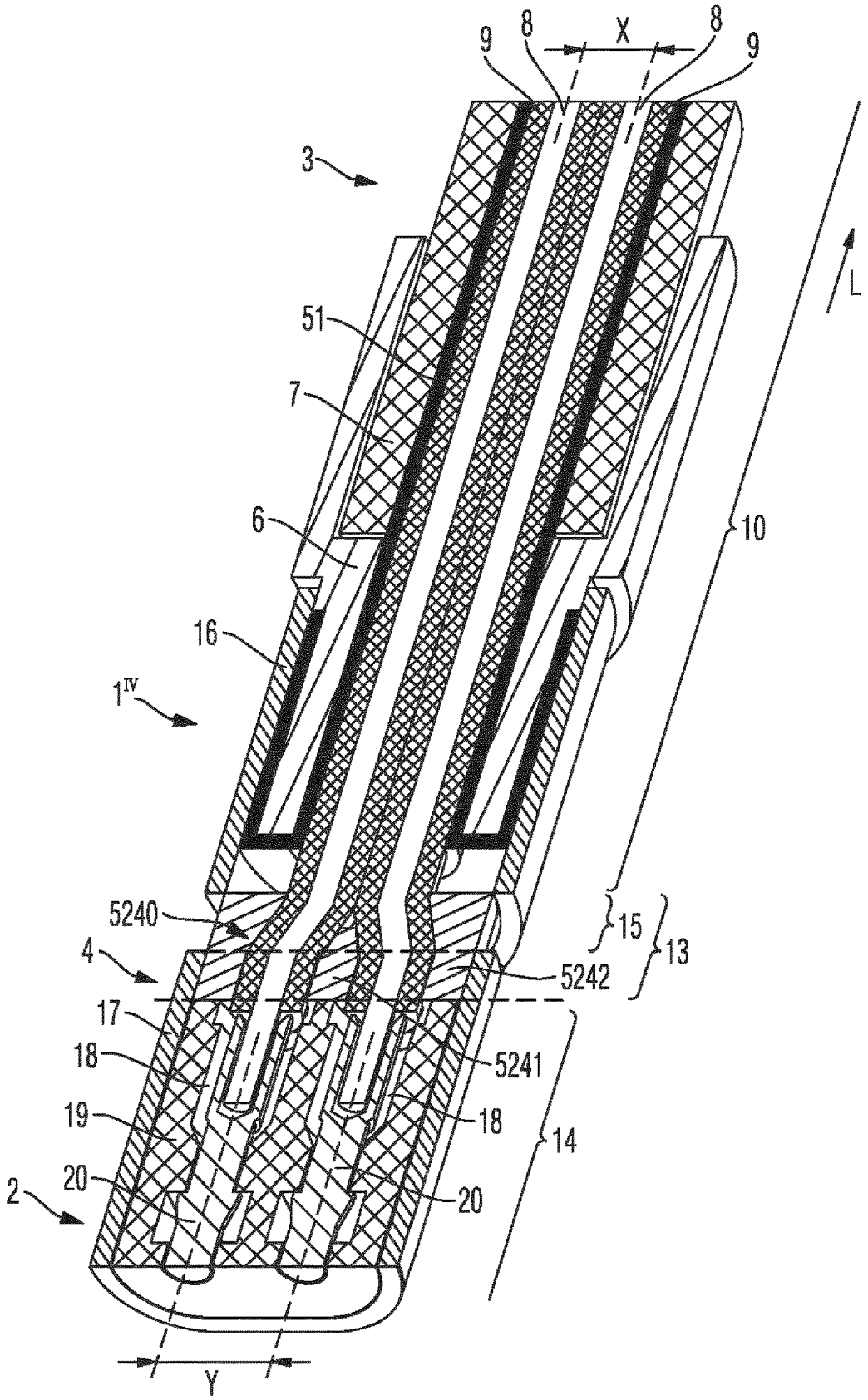
FIG. 4 shows an illustration of a longitudinal section through a further embodiment of the invention.

FIG. 4 shows an embodiments $\mathbf{1}^{IV}$ of the invention, with an alternative shield element 5240 with a shield 5242 for a pair of conductors and conductor shield 5241. The shield 5242 for a pair of conductors extends over the entire intermediate section 13. However, the conductor shield 5241 which forms the shield section extends only over a part of the intermediate section 13 and tapers in the widening section 15 so as to form a trapezoid. The shield element 5240 prespecifies the profile of the conductors 8 by the conductor shield 5242 splitting the conductors 8.

It is clear to a person skilled in the art that compensation of the impedance on account of the changing distance can also be performed in a region in which the distance between the conductors is constant, provided that this region is formed immediately adjacent to the region with the changing distance in the intermediate section.

Figure 5:
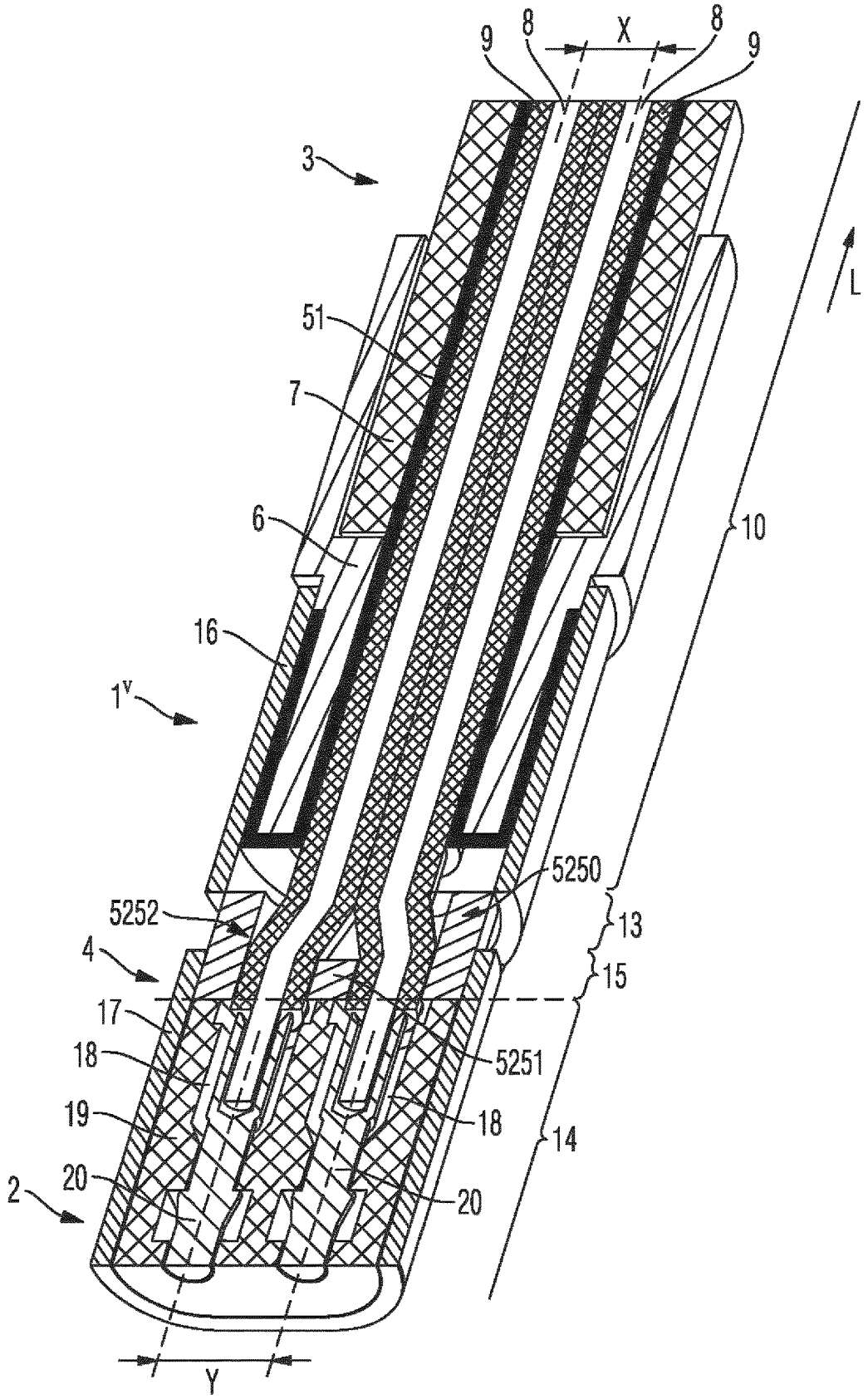
FIG. 5 shows an illustration of a longitudinal section through a further embodiment of the invention.

FIG. 5 shows a further embodiment $\mathbf{1}^{V}$ of the invention, with an alternative shield element 5250 with a shield 5252 for a pair of conductors and conductor shield 5251. The shield 5252 for a pair of conductors extends the entire intermediate section 13. However, the rectangular conductor shield 5251 extends only over a part of the intermediate section and imposes a parallel profile on the conductors 8. The embodiment $\mathbf{1}^{V}$ enables particularly simple production of the connector arrangement.

Figure 6:
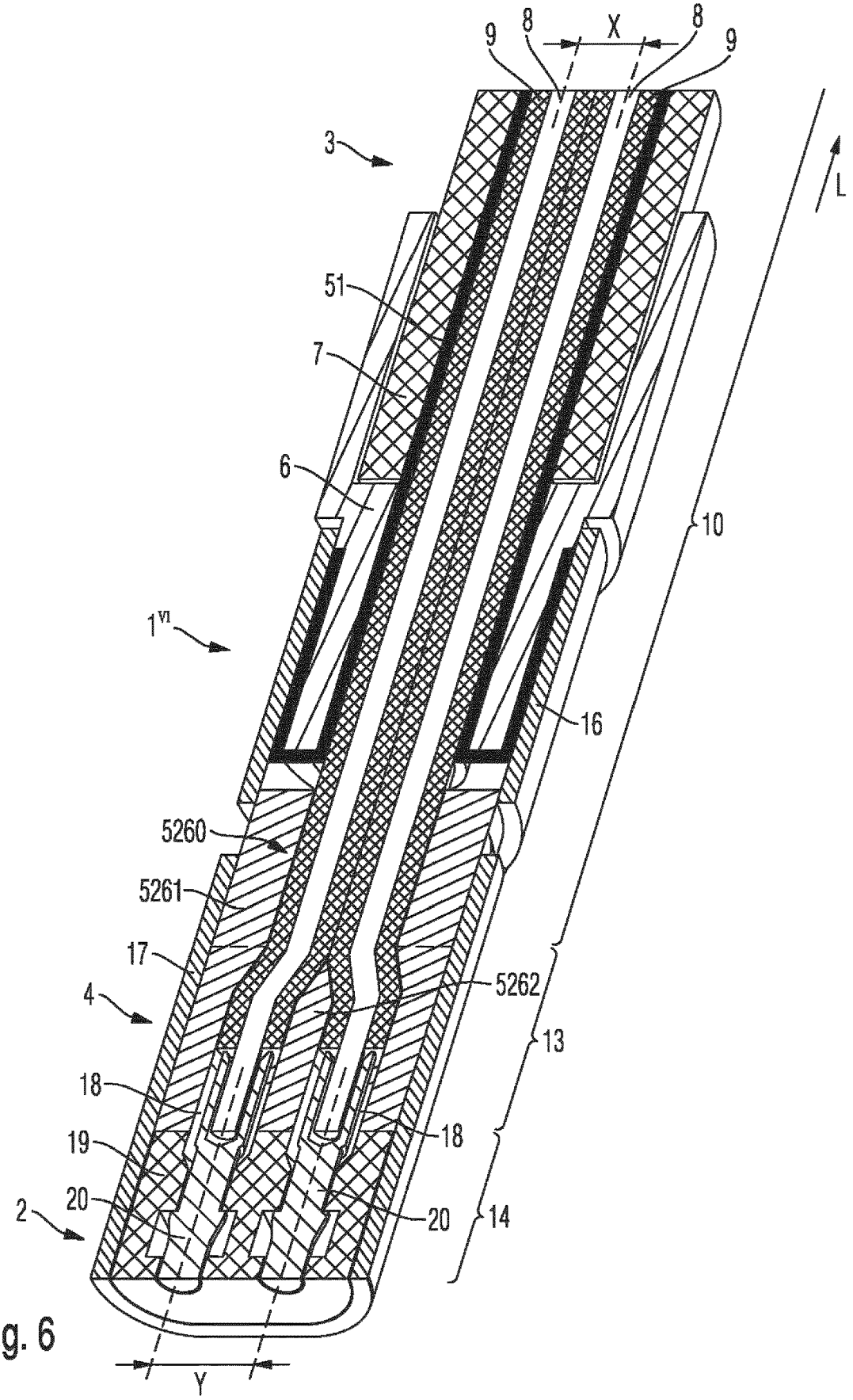
FIG. 6 shows an illustration of a longitudinal section through a further embodiment of the invention.

FIG. 6 shows a further embodiment $\mathbf{1}^{VI}$ of the invention, in which the shield element 5260 with the shield 5261 for a pair of conductors and the conductor shield 5262 extends both over parts of the cable 3 and also over parts of the connector 2 for the purpose of further optimization of the transmission characteristics. In this respect, the intermediate section 13 is not limited to the cable 3 or to the connector 2 either.

Figure 7:
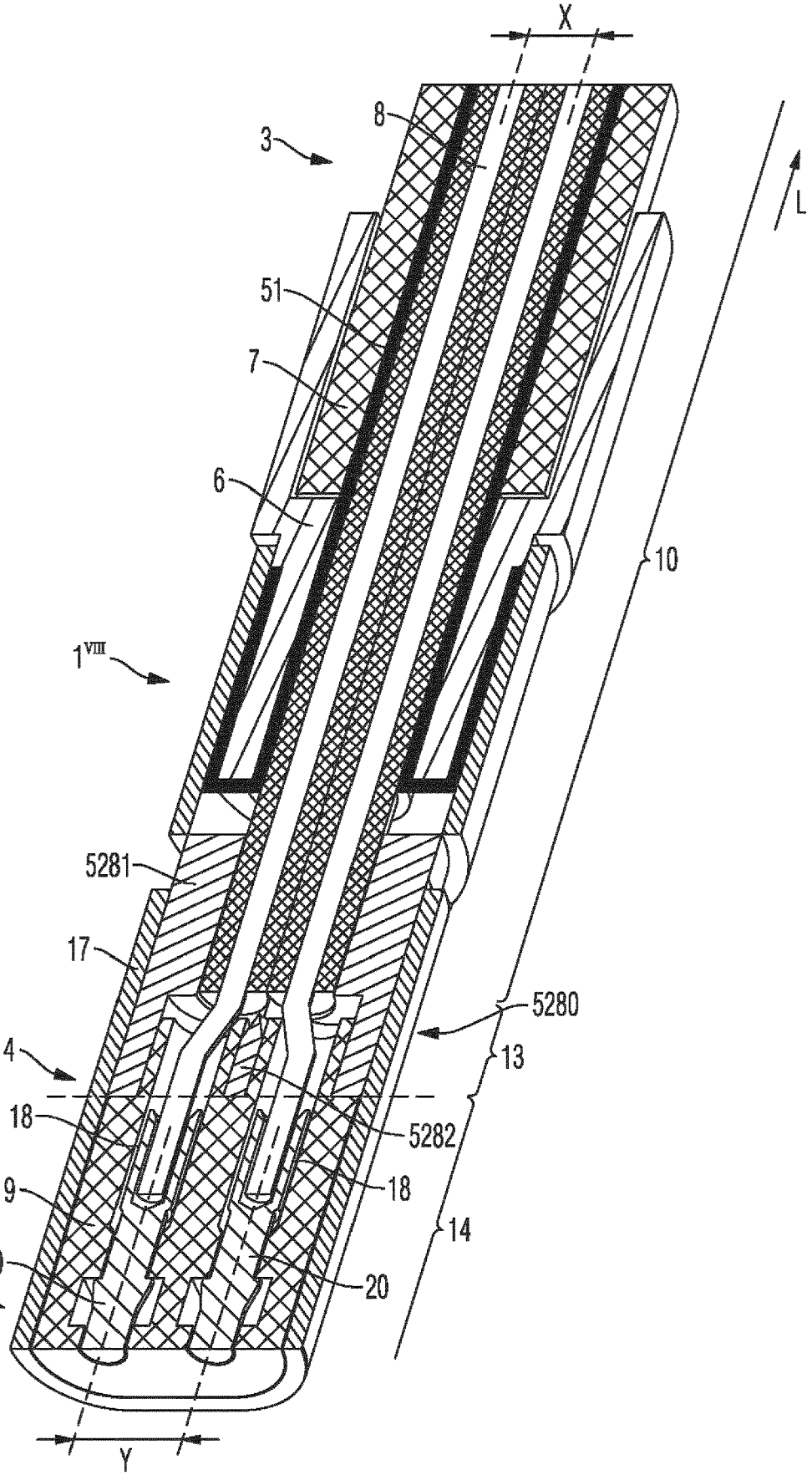
FIG. 7 shows an illustration of a longitudinal section through a further embodiment of the invention.

FIG. 7 shows a further embodiment $\mathbf{1}^{VII}$ of the invention, in which the shield element 5280 is formed by a shield 5281 for a pair of conductors and also by a conductor shield 5282 which is inserted into the insulating part 19. The insulating part 9 of the conductors 8 ends in front of the intermediate section 13.

The insulating part 19 extends along second section 14 and along the intermediate section 13, serves to insulate the conductors in this region and has a recess, which corresponds to the conductor shield 5272, in the intermediate section. Complex shapes, for example cylindrical shapes, or a recess slot, in which a shielding plate is inserted, are feasible here.

The insulating part 19 can be designed to make contact with the converging conductors 8.

Figure 8:
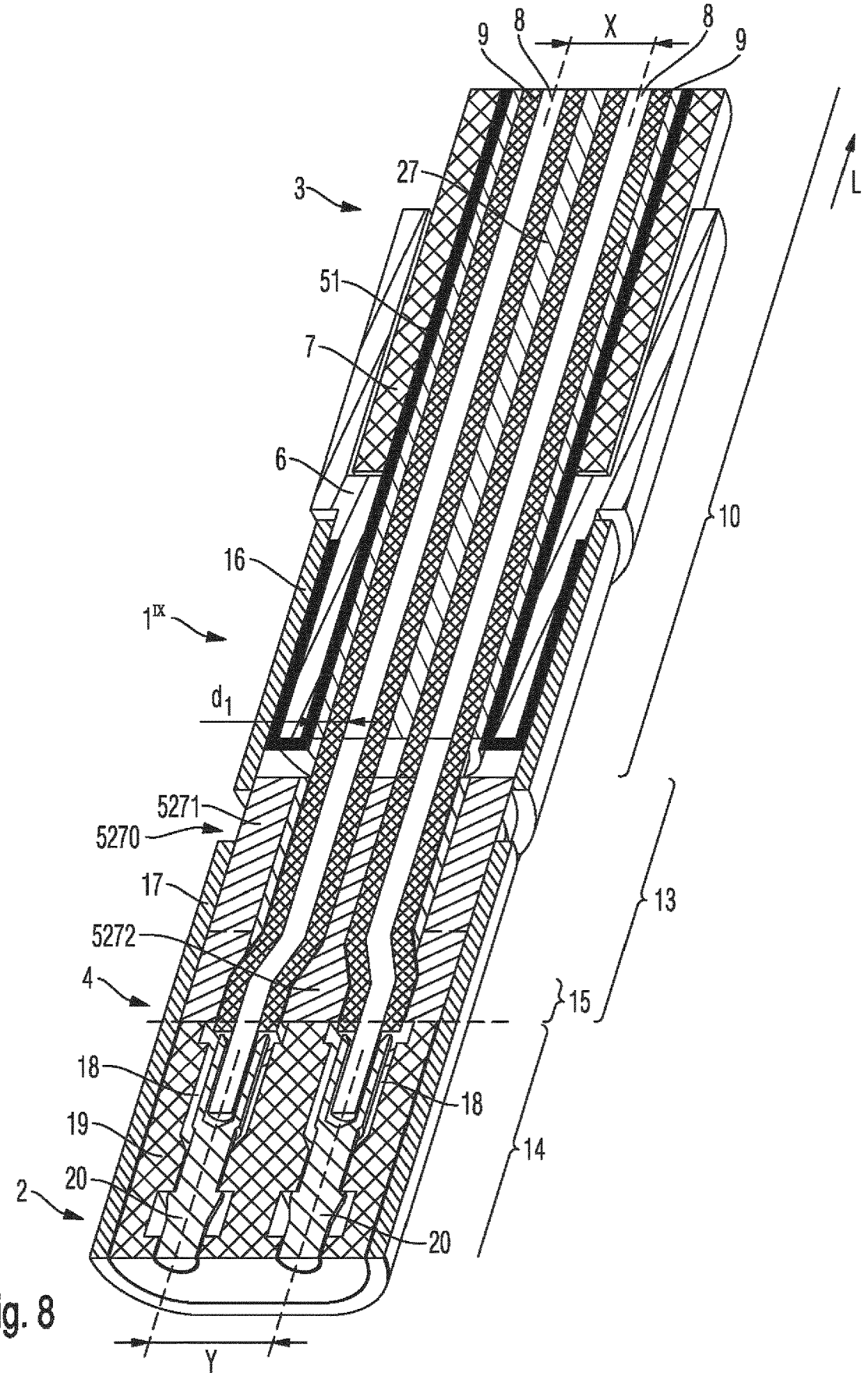
FIG. 8 shows an illustration of a longitudinal section through a further embodiment of the invention.

FIG. 8 shows a further embodiment $\mathbf{1}^{Ix}$ of a connector arrangement according to the invention, in which matching of the impedance $Z_{odd}$ of the differential mode is performed.

On account of the increasing distance between the two conductors 8 in the intermediate section 13, the capacitance $C_{12}$ between the two conductors 8 reduces. As a result, the impedance $Z_{odd}$ of the differential mode increases.

With regard to matching of the impedance $Z_{odd}$ of the differential mode between the individual sections, the impedance $Z_{odd}$ of the differential mode is also likewise "artificially increased" within the cable 3 in the first section 10. To this end, the distance d1 between the conductors 8 and the shield 51 for a pair of conductors, and therefore the capacitance $C_{11}$ between the individual conductors 8 and the shield 51 for a pair of conductors, within the cable 3 is reduced.

The connector $\mathbf{1}^{IX}$ has a dielectric spacer 27 between the conductors 8. The connector $\mathbf{1}^{IX}$ has a shield element 5270 with a shield 5271 for a pair of conductors and a conductor shield 5272 in the intermediate section 13. The shield element can be of unipartite or multipartite design.

FIGS. 9A-9F show different configuration comprising a conductor shield and a shield for a pair of conductors.

Figure 9A:
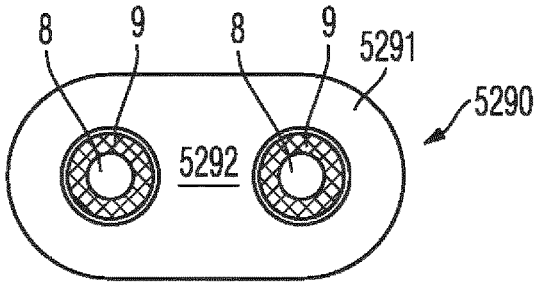
FIGS. 9A-9F show illustrations of a cross section through a further embodiment of the invention.

FIG. 9A shows a further embodiment of the invention with a unipartite shield element 5290 through which the conductors 8 are guided. The shield element forms the outer conductor shield 5291 and also the conductor shield 5292 between the conductors 8.

Figure 9B:
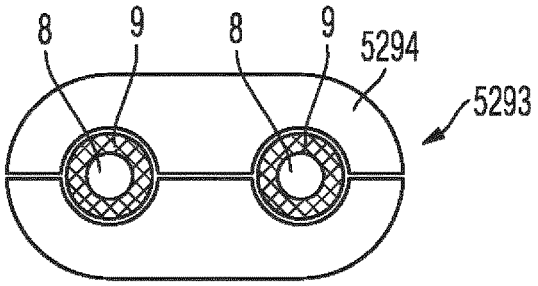

FIG. 9B shows a further embodiment of the invention with a two-part shield element 5293 which has two symmetrical half-shells 5294. The half-shells 5294 are respectively in the form of a negative in relation to the other half-shell and can additionally have a corresponding surface profile, for example serrated profile. For the purpose of guiding the conductors 8, the half-shells 5294 have semicircular depressions which impose a profile on the conductors 8.

Figure 9C:
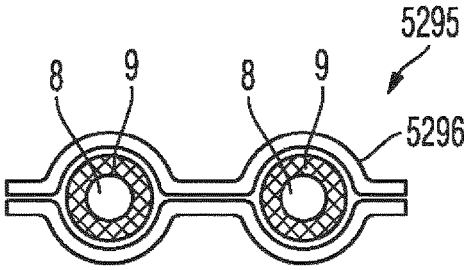

FIG. 9C shows a further embodiment with a shield element 5295 with in each case two symmetrical parts 5296 which are each in the form of a stamped or bent part.

Figure 9D:
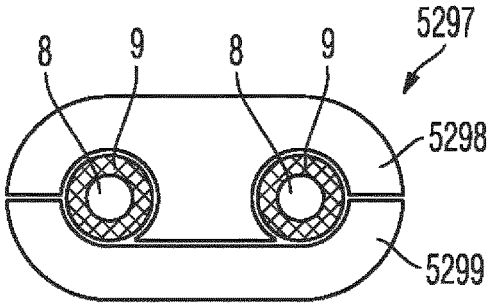

FIG. 9D shows a further embodiment of the invention which is similar to the embodiment according to FIG. 10B. The shield element 5297 has two non-identical shells 5298, 5299 which, when put together, surround the conductors 8.

Figure 9E:
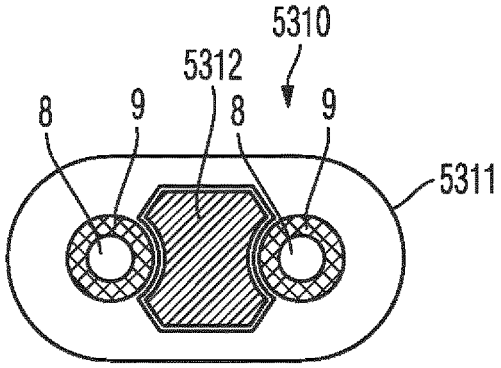

FIG. 9E shows a further embodiment of the invention with a shield element 5310 which has a conductor shield 5312 and a shield 5311 for a pair of conductors. The conductor shield 5312 surrounds approximately one third of the circumference of the conductors. The shield for a pair of conductors can be designed to follow the profile of the insulated conductors 8 in the widening section and can taper to a point or to a wedge in this region.

Figure 9F:
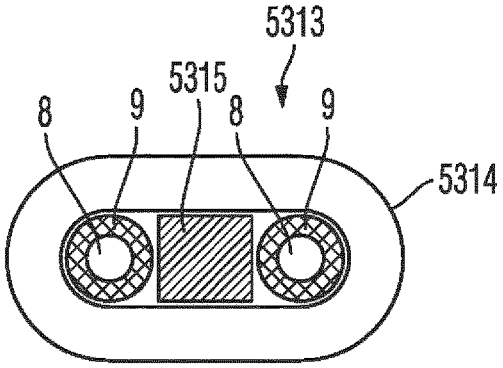

FIG. 9F shows an embodiment with a similar shield element 5313 to FIG. 9E with a different conductor shield 5315 with a rectangular basic area which optionally tapers to a point or to a wedge, and with a different shield 5314 for a pair of conductors.

Figure 10:
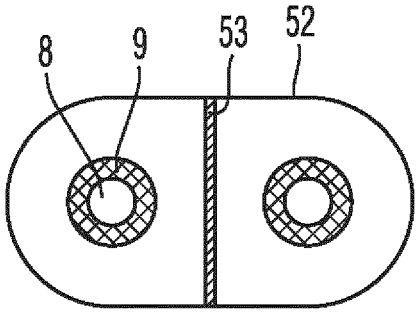
FIG. 10 shows illustrations of a cross section through a further embodiment of the invention.

FIG. 10 shows a sectional view of one embodiment of the invention in the intermediate section. The conductors 8 are surrounded by a shield 52 for a pair of conductors. The intermediate space between the conductors 8 together with their insulating parts 9 and the shield 52 for a pair of conductors is filled with air. A conductor shield 53 which also shields the conductors from one another is inserted into the shield 52 for a pair of conductors. By way of example, the conductor shield 53 can be in the form of a plate and inserted into the shield 52 for a pair of conductors by means of a slot.

Figure 11:
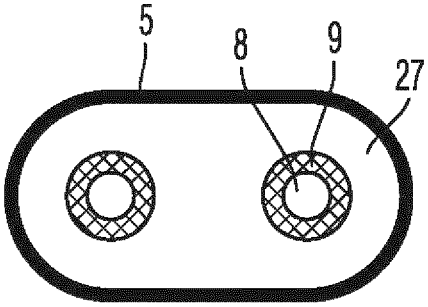
FIG. 11 shows illustrations of a cross section through a further embodiment of the invention.

FIG. 11 shows a further embodiment of the invention. Here, the distance $d_1$ between the conductors 8 and the shield 51 for a pair of conductors is realized by an additional dielectric spacer 27 in the first section 10. This distance $d_1$ is greater than the distance d2 between the conductors 8 and the shield element 52 in the intermediate section 13.

A cable 3 is not limited to one pair of conductors, but rather can also have a plurality of pairs of conductors.

According to FIG. 12A, one shield element with a part 5316 which isolates the conductors 8 and a part 5317 which holds the conductors together is provided for, for example, three pairs 8 of conductors.

Figure 12B:
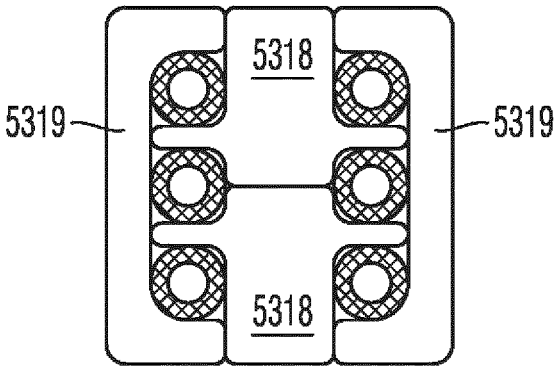

FIG. 12B likewise shows one shield element with a plurality of parts 5318 which isolate the conductors and a plurality of parts 5319 which hold the conductors 8 together for, for example, three pairs 8 of conductors. It is self-evident that this embodiment can be extended or varied as desired.

FIG. 13A shows the reflection behavior 1303 in the spectral region of a connector arrangement according to the invention, the reflection behavior 1302 of a connector arrangement according to DE 20 2015 000 753 U1 and the reflection behavior 1301 of a connector arrangement without shielding at the transition between cable and connector.

Said figure shows that the reflection factor $S_{11}$ of the connector arrangement according to the invention initially undergoes a considerable impairment starting from a frequency f of approximately 7 GHz, while the reflection factor of a connector arrangement without shielding is already considerably impaired starting from a frequency of approximately 0.8 GHz and the reflection factor of a connector arrangement according to DE 20 2015 000 753 U1 is considerably impaired starting from a frequency of approximately 4 GHz.

FIG. 13B shows the pulse behavior 1306 with respect to time t of a connector arrangement according to the invention, the pulse behavior 1305 of a connector arrangement according to DE 20 2015 000 753 U1 and the pulse behavior 1304 of a connector arrangement without shielding at the transition between cable and connector.

The reflective pulse response of the connector arrangement according to the invention in the time range in which the received signal level value is converted into a corresponding impedance value Z is also considerably more severely damped than in a connector arrangement without shielding or in a connector arrangement according to DE 20 2015 000 753 U1.

The invention is not limited to the illustrated embodiments, refinements and subvariants. In particular, all combinations of the features respectively claimed in the individual patent claims, of the features respectively disclosed in the description and of the features respectively shown in the figures of the drawing are also covered by the invention, provided that they are technically expedient.

Although the present invention has been described above entirely on the basis of preferred exemplary embodiments, it is not limited to these, but rather may be modified in a variety of ways.

LIST OF REFERENCE SIGNS

1, 1$^{1, \cdots IX}$ Connector arrangement
2 Connector
3 Cable
4 Cable-side end
6 Supporting sleeve
7 Cable sheath
8 Conductor
9 Insulating part
10 First section
13 Intermediate section
14 Second section
15 Widening section
16 Crimp sleeve
17 Shield for a pair of conductors
18 Guide channels
19 Insulating part
20 Internal conductor contact element
21 Spring element
22 Connector-side end
23 Recess
24 Contact pin
25 Mating connector
27 Spacer
51, 52 Shield for a pair of conductors
53 Conductor shield
5220 Shield for a pair of conductors
5221 Conductor shield
5231 Shield for a pair of conductors
5232 Conductor shield
5240 Shield element
5241 Conductor shield
5242 Shield for a pair of conductors
5250 Shield element
5251 Conductor shield
5252 Shield for a pair of conductors
5260 Shield element
5261 Shield for a pair of conductors
5262 Conductor shield
5270 Shield element
5271 Shield for a pair of conductors
5272 Conductor shield
5280 Shield element
5281 Shield for a pair of conductors
5282 Conductor shield
5290 Shield element
5291 Outer conductor shield
5292 Conductor shield
5293 Shield element
5294 Half-shell
5295 Shield element
5296 Stamped part
5297 Shield element
5298 Shell
5299 Shell
5310 Shield element
5311 Shield for a pair of conductors
5312 Conductor shield
5313 Shield element
5314 Shield for a pair of conductors
5315 Conductor shield
5316 Isolating part
5317 Holding-together part
5318 Isolating part
5319 Holding-together part

The invention claimed is:

1. A connector assembly, comprising:
a connector;
a cable; and
conductive shielding, wherein
said connector comprises a first contact element and a second contact element,
said cable comprises a first conductor pair comprising a first conductor and a second conductor,
in a first portion of said connector assembly, said first conductor is distanced from said second conductor by a first distance,
in a second portion of said connector assembly, said first conductor electrically and mechanically contacts said first contact element and said second conductor electrically and mechanically contacts said second contact element, in a first imaginary plane that transects each of second portion, said first conductor, said first contact element, said second conductor and said second contact element, said first conductor is distanced from said second conductor by a second distance that is substantially greater than said first distance, in said first portion, said conductive shielding forms a first shield substantially around a circumference of said first conductor pair, in said second portion, said conductive shielding forms a second shield substantially around a circumference of said first conductor pair, said conductive shielding forms a third shield substantially around a third portion of said first conductor individually and a fourth shield substantially around a fourth portion of said second conductor individually, each of said third portion and said fourth portion being situated intermediate said first portion and said first imaginary plane, said conductive shielding is not in electrical connection with said first conductor and not in electrical connection with said second conductor, said third portion is not parallel to said fourth portion, and said conductive shielding comprises a conductive spacer that defines a path of said third portion and a path of said fourth portion.

2. The connector assembly of claim 1, wherein:

said first conductor is suitably paired with said second conductor to conduct a differential signal.

3. The connector assembly of claim 1, comprising:

a first insulating component that insulates said first shield from said first conductor pair in said first portion;

a second insulating component that insulates said third shield from said third portion; and a third insulating component that insulates said fourth shield from said fourth portion, wherein said second insulating component has a second thickness smaller than a first thickness of said first insulating component, and said third insulating component has a third thickness smaller than said first thickness.

4. The connector assembly of claim 1, wherein:

said conductive shielding comprises a plurality of components that collectively form said third shield and said fourth shield.

5. The connector assembly of claim 4, wherein:

said plurality of components comprises a plurality of mating partial shells.

6. The connector assembly of claim 4, wherein:

said plurality of components comprises a first component and a second component, said first component comprising a first uneven surface and said second component comprising a second counterpart uneven surface that mates said first uneven surface.

7. The connector assembly of claim 1, wherein:

said conductive shielding comprises a unitary element that forms said third shield and said fourth shield.

8. The connector assembly of claim 1, wherein:

said conductive shielding comprises a first element that forms said third shield and a second element that forms said fourth shield, said first element being distinct from said second element.

9. The connector assembly of claim 1, wherein:

in a second imaginary plane perpendicular to a longitudinal axis of said connector assembly, said first conductor is distanced from said second conductor by said second distance, and said conductive shielding close-fittingly encases an entire outer surface of said first conductor and an entire outer surface of said second conductor from said first portion to said second imaginary plane.

10. The connector assembly of claim 1, wherein:

in said first portion and in said second portion, said first conductor is substantially parallel to said second conductor.

11. The connector assembly of claim 1, wherein:

said connector comprises an insulating element that supports said first contact and said second contact element, and said insulating element comprises a receptacle that receives a portion of at least one of said third shield and said fourth shield.

12. A connector assembly, comprising:

a connector;

a cable; and conductive shielding, wherein said connector comprises a first contact element and a second contact element, said cable comprises a first conductor pair comprising a first conductor and a second conductor, in a first portion of said connector assembly, said first conductor is distanced from said second conductor by a first distance, in a second portion of said connector assembly, said first conductor electrically and mechanically contacts said first contact element and said second conductor electrically and mechanically contacts said second contact element, in a first imaginary plane that transects each of second portion, said first conductor, said first contact element, said second conductor and said second contact element, said first conductor is distanced from said second conductor by a second distance that is substantially greater than said first distance, in said first portion, said conductive shielding forms a first shield substantially around a circumference of said first conductor pair, said conductive shielding forms a third shield substantially around a third portion of said first conductor individually and a fourth shield substantially around a fourth portion of said second conductor individually, each of said third portion and said fourth portion being situated intermediate said first portion and said first imaginary plane, said conductive shielding is not in electrical connection with said first conductor and not in electrical connection with said second conductor, and said conductive shielding comprises a wedge-shaped portion that constitutes a portion of said third shield and a portion of said fourth shield.

13. The connector assembly of claim 12, wherein:

in said second portion, said conductive shielding forms a second shield substantially around a circumference of said first conductor pair.

14. A signal transmission method, comprising:

transmitting a signal as a differential signal in a first portion of a cable using a conductor pair of said cable, said conductor pair comprising a first conductor and a second conductor, said first conductor being substantially parallel to and distanced by a first distance from said second conductor in said first portion, transmitting said signal as a differential signal in a second portion of said cable using said conductor pair, said first conductor being substantially parallel to and distanced by a second distance from said second conductor in said second portion, said second distance being substantially greater than said first distance, and transmitting said signal as an asymmetric signal in a third portion of said cable intermediate said first portion and said second portion, wherein said third portion comprises a fourth portion of said first conductor and a fifth portion of said second conductor that is not parallel to said fourth portion, each of said fourth portion and said fifth portion is individually shielded by conductive shielding, said conductive shielding is not in electrical connection with said first conductor and not in electrical connection with said second conductor, said conductive shielding is formed substantially around each of said first conductor and said second conductor, and said conductive shielding comprises a conductive spacer that defines a path of said fourth portion and a path of said fifth portion.

15. The method of claim 14, wherein:

throughout an entire length of said third portion from said first portion to said second portion, each of said first conductor and said second conductor is individually shielded by said conductive shielding, and said conductive shielding is formed substantially around each of said first conductor and said second conductor, said conductive shielding being insulated from said first conductor and said second conductor.

16. A connector assembly, comprising:

a connector;

a cable attached to and extending into said connector;

conductive shielding, wherein said cable comprises a first conductor pair comprising a first conductor and a second conductor, in a first portion of said cable, said first conductor is distanced from said second conductor by a first distance, in a second portion of said connector, said first conductor is distanced from said second conductor by a second distance that is substantially greater than said first distance, in said first portion, said conductive shielding forms a first shield substantially around a circumference of said first conductor pair, in said second portion, said conductive shielding forms a second shield substantially around a circumference of said first conductor pair, in at least a portion of a third portion of said connector assembly intermediate said first portion and said second portion, said conductive shielding forms a third shield substantially around said first conductor individually and a fourth shield substantially around said second conductor individually, said conductive shielding comprises a plurality of components that collectively form said third shield and said fourth shield, and said plurality of components comprises a first component and a second component, said first component comprising a first uneven surface and said second component comprising a second counterpart uneven surface that mates said first uneven surface.

17. A connector assembly, comprising:

a connector;

a cable; and conductive shielding, wherein said connector comprises a first contact element, a second contact element and an insulating element that supports said first contact and said second contact element, said cable comprises a first conductor pair comprising a first conductor and a second conductor, in a first portion of said connector assembly, said first conductor is distanced from said second conductor by a first distance, in a second portion of said connector assembly, said first conductor electrically and mechanically contacts said first contact element and said second conductor electrically and mechanically contacts said second contact element, in a first imaginary plane that transects each of second portion, said first conductor, said first contact element, said second conductor and said second contact element, said first conductor is distanced from said second conductor by a second distance that is substantially greater than said first distance, in said first portion, said conductive shielding forms a first shield substantially around a circumference of said first conductor pair, in said second portion, said conductive shielding forms a second shield substantially around a circumference of said first conductor pair, said conductive shielding forms a third shield substantially around a third portion of said first conductor individually and a fourth shield substantially around a fourth portion of said second conductor individually, each of said third portion and said fourth portion being situated intermediate said first portion and said first imaginary plane, said conductive shielding is not in electrical connection with said first conductor and not in electrical contact with said second conductor, and said insulating element comprises a receptacle that receives a portion of said conductive shielding.

18. The connector assembly of claim 17, wherein:

said receptacle is situated intermediate said first conductor and said second conductor.

19. The connector assembly of claim 17, wherein:

said receptacle receives a portion of at least one of said third shield and said fourth shield.

* * * * *